United States Patent [19]

Papst et al.

[11] 3,961,864

[45] June 8, 1976

[54] RADIAL FLOW FAN

[75] Inventors: Georg Papst, St. Georgen; Guenter Wrobel, Villingen, both of Germany

[73] Assignee: Papst-Motoren KG, Germany

[22] Filed: Nov. 23, 1973

[21] Appl. No.: 418,213

[30] Foreign Application Priority Data

Nov. 23, 1972 Germany ..... 2257509

[52] U.S. Cl. ..... 417/354; 29/509; 416/244 A; 416/241 A; 417/360; 415/219 C; 310/63; 310/91

[51] Int. Cl.[2] ..... F04B 35/04; B63H 1/28; H02K 5/00; H02K 9/00

[58] Field of Search ..... 417/354, 353, 352, 360; 416/244, 241 A; 310/67, 62, 63; 29/509, 156.8 CF

[56] References Cited

UNITED STATES PATENTS

| | | | |
|---|---|---|---|
| 2,652,190 | 9/1953 | Meltzer et al. | 416/241 A |
| 2,768,583 | 10/1956 | Richard et al. | 417/354 |
| 3,175,755 | 3/1965 | Rockcfield | 417/354 |
| 3,597,117 | 8/1971 | Zoehfeld | 417/354 |
| 3,642,382 | 2/1972 | Hayashi | 416/241 A X |
| 3,734,697 | 5/1973 | Sieghartner | 29/156.8 CF |

*Primary Examiner*—Carlton R. Croyle
*Assistant Examiner*—Richard E. Gluck
*Attorney, Agent, or Firm*—Craig & Antonelli

[57] ABSTRACT

A radial flow fan of short axial length and large radial dimensions and of the type having the drive motor arranged coaxially with respect to the fan wheel and at least partly inside of the fan wheel. The housing for the fan wheel and motor includes a flat metallic square plate forming an axial end face and a synthetic resinous material circumferential housing attached to the metal plate. The circumferentially extending housing portion also includes a portion defining the opposite end wall of the casing with respect to the metal plate end wall, which opposite end wall has a central opening for inlet of air. The synthetic resinous housing portion includes an exit port for radial exit of the air. The metal plate is connected with good heat conductivity with the stator of the drive motor by way of a flange of a bearing for the shaft of the drive motor and by way of a contact disc which axially supports the rotor shaft at the metal plate. The contact disc is constructed so as to simultaneously form a resilient support for the rotor shaft and a firm seal at the bearing sleeve. The fan blades are connected to the rotor by way of a collar having offset portions engageable with corresponding offset portions of the rotor and with deformable wall members on the rotor engageable in recesses on the blade wheel collar so as to hold the same in position. Axially extending cooling bores are provided also through short circuit rings of the rotor which interconnected with a circumferentially extending groove bounded in part by the bendable portions forming the rivet connection with the collar. The outer edges of the inlet opening are disposed at approximately one-half the radial length of the blades. The blades are spaced from the wall forming the inlet opening by a distance corresponding to approximately one-fourth of the radial length of the blades.

20 Claims, 5 Drawing Figures

RADIAL FLOW FAN

BACKGROUND AND SUMMARY OF THE INVENTION

This invention relates to a radial flow fan with a central drive motor arranged coaxially with respect to a fan wheel or impeller and substantially inside this fan wheel, wherein the fan wheel diameter is larger than three times its axial length, with air inlet ports disposed at one large-area end face of a fan casing or housing, and with radial discharge through an exhaust port arranged in the casing adjacent the circumference of the fan wheel. Fans of this type serve for the ventilation and/or heat removal in photomechanical or electronic equipment or similar devices. The requirements to be met by such a fan, in addition to the maintenance of certain dimensions for installation in given apparatus, are an optimum conveying power (volume/time in dependence on the pressure) and low noise.

U.S. Pat. No. 3,597,117, which is incorporated herein by reference, discloses a fan of the above-mentioned type. Although the fan of this patent is of relatively small volumetric construction, it is disadvantageous with respect to complexity of construction, and delivery efficiency. The present invention is directed in part to overcoming these disadvantages.

The invention is based on the problem of improving the delivery efficiency of a radial flow fan of the above-described type. This objective is accomplished, according to one aspect of the invention, by providing the large-area end face of the casing which is disposed oppositely to the end face with the air inlet ports with a metallic plate which is connected with good heat conductance with the stator of the drive motor. (See plate 4, stator 1, rotor 2 in FIG. 3). This feature of the present invention makes it possible to place a greater load on the motor, without the latter reaching or exceeding a maximum, permissible critical temperature. Therefore a rotor with a higher moment requirement can be utilized and thus effectively a better delivery efficiency can be attained for a given total installation, size and energy input.

The present invention further contemplates providing the fan drive motor with an external rotor and internal stator and to mount the internal stator over its central coaxial bearing sleeve, with an end-face flange to the metallic plate 4, preferably in a releasable manner.

For an additional support of the intended effect, the present invention further contemplates providing additional heat-dissipating means arranged between the coil winding heads of the rotor and the metallic plate 4.

For a clearly economical realization of the present invention, it is furthermore proposed to fashion the motor as a double-pole shaded-pole motor with such a position in the housing or casing that a pole clearance, i.e. also a coil winding head gap of the stator, is oriented toward the exhaust port.

In an alternative preferred embodiment, a considerable improvement is also obtained by providing the drive motor with a symmetrical polyphase winding. This permits a reduction of the size of the motor and, correspondingly, affords a further improvement in the flow characteristic of the fan, for example due to the fact that the flow can be controlled more effectively since impeding fixed components have become smaller.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
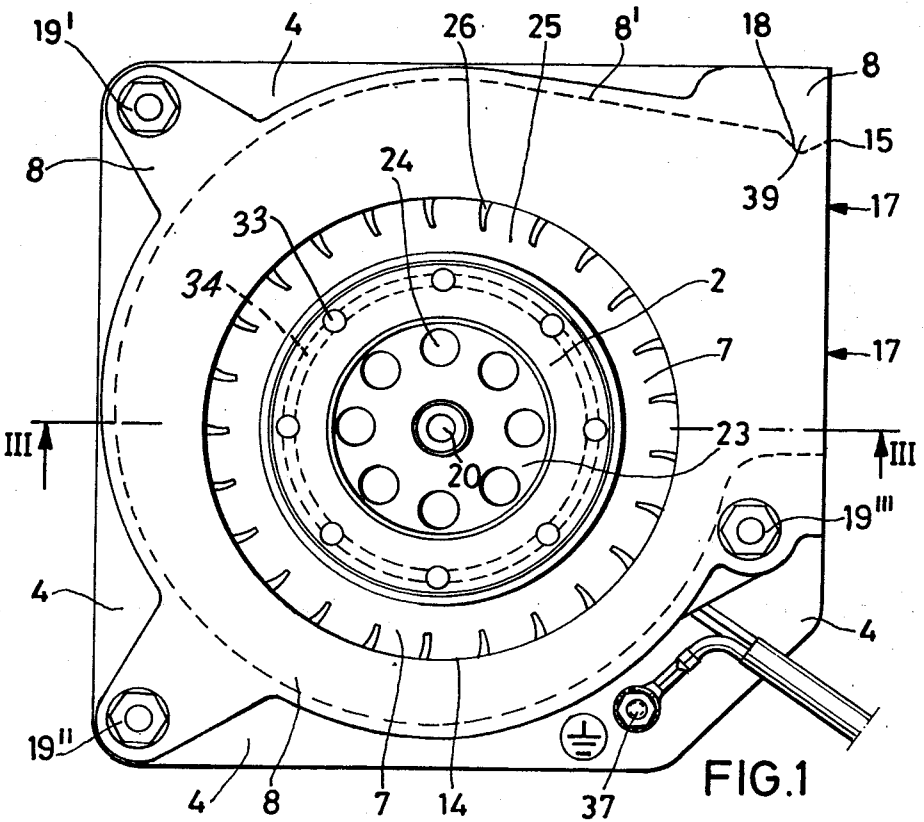
FIG. 1 is a vertical top view of a fan constructed according to a preferred embodiment of the invention.

FIG. 1 shows the overall configuration of the fan, which includes a motor having a stator 1 and a rotor 2. The fan casing includes a metallic casing wall 4 of square configuration and a casing 8 attached to wall 4 which forms both the opposite end wall of the casing with respect to the plate 4 and the circumferentially extending wall portions. As best seen in FIG. 1, the spacing of the casing portions 8 from the peripheral edges of the plate 4 decreases in the direction of rotation (clockwise as seen in FIG. 1) of the fan rotor, with a maximum spacing at the lower right-hand corner and a minimum spacing adjacent the exhaust port 17. Casing member 8 also includes flange portions for accommodating attachment thereof to the plate 4 by way of the screw means 19', 19'' and 19'''.

The right-hand lower corner of the middle plate 4 is beveled approximately at an angle of 45°. The electrical feed line for the motor is arranged above the beveled part and includes a separate ground terminal 37 on the plate 4.

The upper edge of the exhaust port opening 17 extends in parallel to the upper edge of the metal plate 4 with the wall of the casing 8 being extended so as to completely fill the right-hand upper corner of the square profile of the plate 4.

The centrally disposed rotor 2 of the drive motor, along with its coaxial impeller 25 and blades 26 is arranged concentrically within the inlet opening 7 of the casing 8.

The inwardly facing circumferential wall portions 8' of casing 8 are indicated in dash lines in FIG. 1 and depict the continuously increasing spacing between the periphery of the blades of the impeller 25 and the inside walls 8' in the clockwise direction. These inwardly facing walls 8', as well as the cylindrical outer periphery of the blades of the impeller or blade wheel, are in parallel to the axis of the rotor shaft 20.

Figure 2:
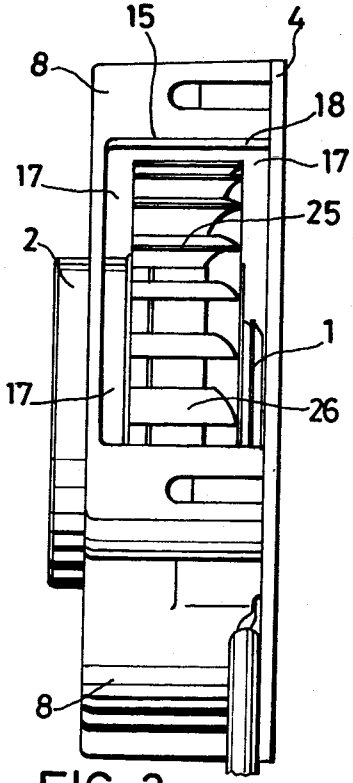
FIG. 2 is a lateral view taken from the right-hand side of FIG. 1.

FIG. 2 shows a lateral view from the right-hand side of the arrangement of FIG. 1, with the rectangular contour of the exhaust port 17 being visible in this Figure. The upper boundary of the opening 17 is depicted with two parallel lines in the FIG. 2 view. The lower line indicates the downward extremity of the projection 39 (also see FIG. 1) in the surface of the inner wall of the housing 8, which is arranged at the inner wall of the housing 8 at the exit for the stream of air through outlet port or opening 17. This nose-like projection 39 prevents a surge-like conveyance of the air in the event of free, or almost free, operation of the fan (that is, with a small counter pressure, without, surprisingly, impairing the fan and the other operating ranges). This projection 39 also results in an improvement of the noise characteristics of the fan. In preferred arrangements, this projection 39 is in the form of a prism extending axially out of the fan and having the cross section of a triangle, the base of which is approximately 10mm wide. The height of the triangle forming the cross section of the projection is preferably 3 to 5 mm.

Figure 3:
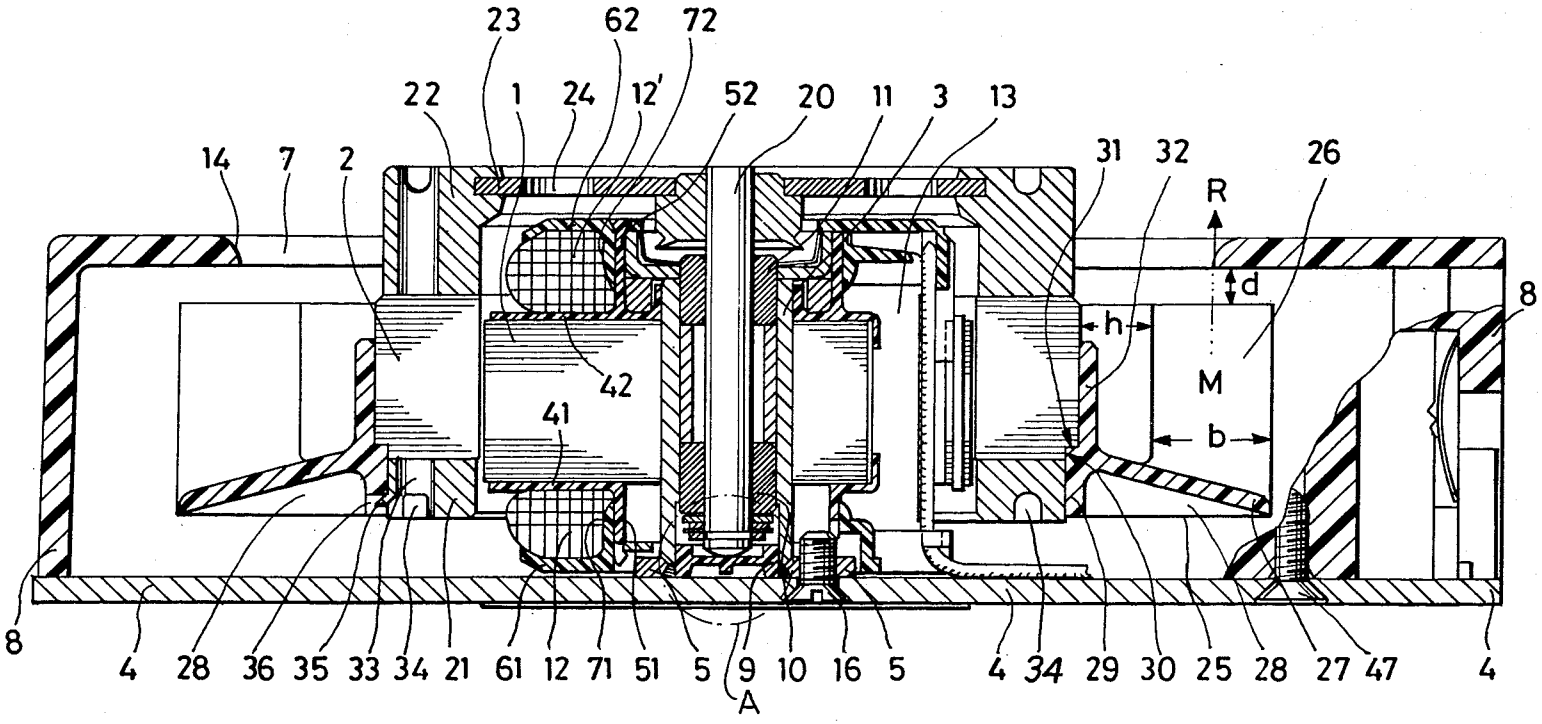
FIG. 3 is an axial longitudinal sectional view of the arrangement of FIG. 1, scaled 2 : 1, and taken along the section line III—III.

Referring now to FIG. 3, the stator 1 is provided with a bearing sleeve 3 having a flange-like extension 5 which has a larger end surface (that is, it extends radially outwardly of the sleeve 3). The stator 1, and thus the entire motor with fan wheel are attached to the metal plate 4 by means of screws 16 engaging in the large end surface formed by the flange-like extension 5. The bearings 10 and 11 are arranged in the bearing sleeve 3, with the rotor shaft 20 rotating in these bearings.

By way of a metallic disk 23, which exhibits openings 24, the shaft is connected for rotation with the externally rotating rotor or cage housing 2. Short circuit rings 21 and 22 form part of the rotor.

Coil winding heads 12 and 12' are disposed respectively in the proximity of the metal plate 4 and adjacent the side 23 of the housing of the rotor 2. Between these heads 12 and 12' and the laminated pack of the stator, insulating end disks 41 and 42 are provided with collar-like extensions 51 and 52 carrying insulating cover caps or disks 61, 62 and rotational symmetry, which carry out a sealing function, the core winding heads are also covered by these cover caps 61 and 62. These caps 61 and 62 also have collar-like extensions 71, 72 which interlock with a slight press fit, namely, 51 is joined to 71, and 52 is joined to 72.

FIG. 3 illustrates the motor, the stator 1 of which is provided with a shaded-pole winding, the right hand half of the drawing showing the section through a pole clearance wherein a coil-winding headgap is arranged. The indented groove 13 in the coil-winding head gap is located underneath the litz (length of wire or braded wire) wire lead. By appropriately making the cover disk or appropriately forming the cover caps 62, 61 and the insulating end disks 41 and 42 and by aligning the pole clearance or coil-winding headgap with respect to the exhaust port 17, an additional cooling air stream can be drawn through the stator. This additional cooling air stream is drawn through the stator because with such a construction according to the present invention, a pressure gradient is formed through the openings 24 along the groove 13 passing through underneath the impeller or fan wheel 25 to the metallic plate 4, due to the relatively high pressure difference between the exhaust port 17 and the end face on the inlet side. Thus, a pronounced cooling flow additionally vents the internal stator.

Figure 4:
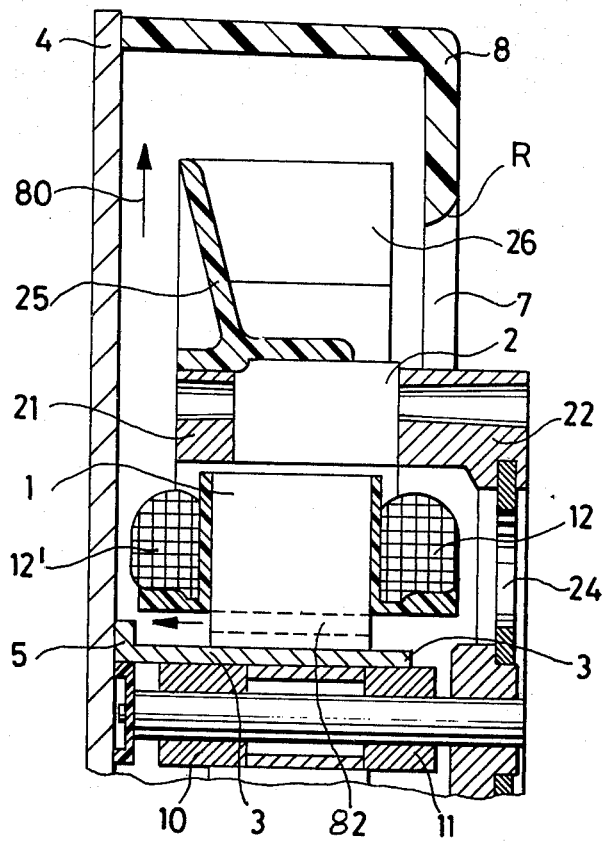
FIG. 4 is a partial sectional view showing a modification of the fan of FIG. 1, wherein means for drawing a secondary air stream through the stator laminations are provided.

FIG. 4 shows a specifically modified embodiment of the invention for the purpose of providing a pronounced additional cooling flow for venting the internal stator. A flow as described above is generated through the opening 24 along a bore 82 in the stator lamination pack, past the coil winding heads 12, 12' into the zone of the metal plate 4, and is then continued in the direction of arrow 80. FIG. 4 also shows the bearing sleeve 3 with flange section 5 as an integral part thereof, while, in FIG. 3, the flange section 5 is soldered or welded to the tubular part 3.

In the short-circuit end ring 21 of FIG. 3, a plurality of bores 33 (the first one being illustrated in the sectional view) are distributed along the circumference. The continuous annular groove 34 extends through and communicates with the bores 33. This continuous annular groove 34 is bounded in the radially outward direction by the external annular wall 35 which forms part of the short-circuit ring 21. During the electrodynamic balancing of the rotor, weighting lead is inserted in the continuous annular groove 34.

In the zone of the short-circuit ring 21, the rotor 2 has an offset portion limited by the cylindrical surface 30 and the planar area 31. The collar 29 of the fan wheel 25 is configured so that it can be pushed, with a slight press fit, over the surface 30 until abutment at stop 31 is attained. The collar 29 has, at its lower edge, several recesses 36 uniformly distributed along the circumference thereof. At these recesses 36, the wall 35 is bendable radially outwardly and is then axially forced into the recesses 36 to form a rivet-type connection of the fan wheel 25 and the rotor 2. The farther projecting shoulder 32, which axially projects at the periphery of the fan wheel 25, has a play of 0.1 – 0.2 mm. with respect to the outer diameter of the rotor lamination pack so as to accomodate secure execution of the slight press fit in the zone of the wall 35. This force-fit connection arrangement for the mounting of the fan wheel to the rotor may also advantageously be applied to other types of fans, such as axial flow fans, in accordance with the present invention. Since the axial flow fan embodiments would include similar details insofar as the connection of the rotor and the fan wheel, the details thereof have not been illustrated herein.

The fan wheel 25 is made of a synthetic resin (or as a deep-drawn part) and comprises the axially oriented collar section 29 and the radially oriented peripherial section 27. The individual radial blades 26 are connected to the peripheral section 27. In other non-illustrated preferred embodiments, the collar extension 32, which extends upwardly from the radially extending peripheral section 27, is omitted with a resultant improvement in the heat emission characteristics by the resultant communication of the cylindrical outer surface of the rotor lamination pack directly with the flow of air through the fan. According to other preferred non-illustrated embodiments, the reinforcing ribs 28 can optionally also be omitted, however, especially in case of a synthetic resinous fan wheel 25, these reinforcing ribs 28 represent a desirable stabilization for the fan blades. These reinforcing ribs 28 are oriented radially and uniformily distributed over the circumference, with the preferred embodiment including twelve ribs 28.

The mounting of the fan wheel 25 to the rotor 2 in the manner described above avoids a cumbersome cementing process and furthermore affords the advantage that practically complete independence is attained from temperature changes. In this connection it is preferred that the cylindrical surface 30 and planar surface 31 be manufactured together in one operation so as to assure a flush contact of a collar portion 29 of the fan wheel 25, with a resultant flawless, concentric operation of the fan.

The inlet port 7 of the casing 8 concentrically surrounds the rotor 2 (see FIG. 3, wherein the concentric arrangement of the opening 7 with respect to the outer circumference of the short circuit ring 22 of the rotor is depicted). The ridge portion R of the inlet port of the casing 8 is rounded and is disposed in a radial position approximately in the center M of a blade 26, which blade has the width (length in the radial direction) $b$ and exhibits a spacing $d$ from the casing wall on the inlet side. The casing and blade wheel are dimensioned and positioned so that the relationship $b = 4\ d$ is approximately maintained. The radial width of the annular inlet opening which is underneath the blade ring and above the rotor, and is designated by $h$ in FIG. 3, is approximately 2 to 3 times as great as the spacing $d$.

Figure 5:
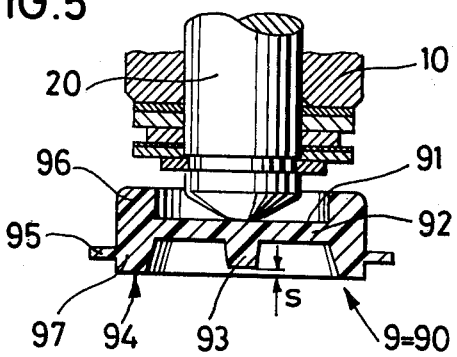
FIG. 5 is an enlarged sectional view, scaled 5 : 1, which shows details of a portion of the fan of FIGS. 1 to 3.

FIG. 5 illustrates the detail "A" of FIG. 3 in five-fold enlargement, as compared to the two-fold enlargement of FIG. 3. As best seen in FIG. 5, the motor shaft 20 abuts, with the rotor weight, axially against the contact disk 90. The rotor shaft 20 is polished at its rounded end portion and the contact surface 91 of the contact disk 90 is also smoothly polished without scoring. The contact disk 90 preferably consists of "Molykote" — (a trademark name for a solid film lubricant) — containing synthetic resin. Contact disk 90 is of an especially advantageous configuration, since the contact surface 91 and/or the abutment area 92 do not come into hard engagement with the rotor shaft 20 and plate 4, but rather, a shock-absorbing resilient deformation of the contact disk 90 takes place. This resilient movement is provided for by the support of the working surface 91 as a resilient diaphragm disposed intermediate the circumferentially surrounding portions, which surrounding portions engage by way of planar end face 94 at the end wall 4 of the plane casing. Because of the automatic, resilient adaptation to various forces by way of shaft 20, an axial adjustment of the position of the abutting surface 91 is unnecessary.

In order to prevent that the bottom 92 of the disk sags beyond a permissible degree, a concentric extension 93 is provided, which extension 93 is spaced by a distance s with respect to the planar end face 94 of the disk. This gap s constitutes the maximum permissible sag, since in such an extreme case, the extension 93 contacts, in the assembled condition, the metal plate 4 in the plane 94.

In order to also provide a seal regarding the innersurface of the bearing sleeve, the abutment disk 90 also includes an elastic sealing, annular edge or shoulder 95 which extends continuously along the outer circumference thereof. This shoulder 95, during assembly, is sealingly brought into contact with the bearing sleeve 3 and/or the flange 5 by deformation due to the tightening of the screw 16. This deformation of the annular shoulder 95 during assembly counteracts the sagging of the bottom 92 under the weight of the rotor, and thus is additionally effective as a type of counter bias. By making the annular shoulder 95 of a greater axial thickness and by disposing the same approximately in the zone of the bottom 92, this counter biasing effect is still further enhanced. The bottom 92 is arranged between the radially thick collars 96 to collar 97. This annular shoulder 95 also forms an abutment during assembly. Therefore, the above-described advantageous effects are obtained similtaneously by means of the single component 90 – 97 of the present invention, which component is inexpensively made of a synthetic resin, with a maximally simple assembly.

Detailed technical data concerning specific embodiments of fans constructed in accordance with the present invention are included in a brochure of PAPST-MOTOREN KG of 7742 St. Georgen/Schwarzwald, Germany, which brochure is titled "Neue Kleinst-Radiallufter Typ RL 90 – 18," the contents of said brochure being incorporated by reference herein.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A radial flow fan comprising:

fan wheel means which includes a plurality of fan blades and is rotatable about a fan wheel axis, drive motor means arranged coaxially with respect to the fan wheel means for imparting rotational movement to said fan wheel means, at least part of said drive motor means being arranged within the fan wheel means intermediate the outer periphery of the fan wheel means and the fan wheel axis, said drive motor means including a stator and a rotor, fan casing means including circumferentially extending casing wall means which extends circumferentially around said fan wheel means at a spacing therefrom and casing end wall means at each of the respective opposite axial end faces of said circumferentially extending wall means, outlet port means provided in said circumferentially extending wall means for accommodating discharge of gas out of said casing means in a radial direction with respect to the axis of rotation of the fan wheel means, and inlet port means in a first of said end wall means for accommodating flow of gas into said casing means in communication with said fan blades, wherein said rotor includes a plurality of bores therethrough distributed along the circumference of a short-circuit end ring of said rotor, said plurality of bores extending parallel to said fan wheel axis, and wherein a continuous annular groove is provided at the axial end of said rotor facing a second of said end wall means, said annular groove being communicated with said bores and being defined on the outside by an external annular groove wall, said annular groove wall including portions bendable over portions of a collar of said fan wheel means to connect said fan wheel means to said rotor.

2. A fan according to claim 1, wherein said rotor has an offset portion defined by a cylindrical surface extending parallel to the fan wheel axis and a planar surface extending transverse to said fan wheel axis, and wherein said collar of said fan wheel means includes a corresponding offset portion engageable over said offset portion of the rotor with a slight press fit between the respective cylindrical surfaces and abutting engagement of the respective planar surfaces, said collar including a plurality of recesses around the circumference thereof for accepting said bendable portions of said annular groove wall to lock said collar into position on said rotor with a rivet type connection.

3. A fan according to claim 2, wherein said collar of said fan wheel is constructed of synthetic resinous material.

4. A fan according to claim 3, wherein said collar of said fan wheel means includes an axially oriented collar section and a radially oriented peripheral section where the individual blades are attached.

5. A fan according to claim 4, wherein said axially oriented collar section extends only partially over a rotor lamination pack of the rotor so as to assure a free exposure of the lamination pack to the gas flow in the fan.

6. A fan according to claim 5, wherein said collar of said fan wheel means includes reinforcing ribs distributing uniformly around the circumference of the collar for reinforcing the mounting of said blades to said radially oriented peripheral section.

7. A fan according to claim 2, wherein said cylindrical surface and planar surface of said rotor are formed in one operation so as to assure the flush contact with corresponding portions of said collar of the fan wheel means.

8. A fan according to claim 7, wherein said cylindrical surface and planar surface of said rotor are formed in a laminated pack of said rotor.

9. A fan comprising:

fan wheel means which includes a plurality of fan blades and is rotatable about a fan wheel axis, and drive motor means for imparting rotational movement to said fan wheel means, said drive motor means including a stator and a rotor, wherein said fan wheel means includes a fan wheel mounting collar supporting said fan blades, wherein said rotor has an offset portion defined by a cylindrical surface extending parallel to the fan wheel axis and a planar surface extending tranverse to said fan wheel axis, and wherein said collar of said fan wheel means includes a corresponding offset portion engageable over said offset portions of the rotor with a slight press fit between the respective cylindrical surfaces and with abutting engagement of the respective planar surfaces, said collar including a plurality of recesses around the circumference thereof for accepting bendable portions of a wall forming an annular groove in said rotor so as to lock said collar into position on said rotor with a rivet-type connection.

10. A fan according to claim 9, wherein said collar of said fan wheel is constructed of synthetic resinous material.

11. A fan according to claim 10, wherein said collar of said fan wheel means includes an axially oriented collar section and a radially oriented peripheral section where the individual blades are attached.

12. A fan according to claim 11, wherein said axially oriented collar section extends only partially over a rotor lamination pack of the rotor so as to assure a free exposure of the lamination pack to the gas flow in the fan.

13. A fan according to claim 12, wherein said collar of said fan wheel means includes reinforcing ribs distributing uniformly around the circumference of the collar for reinforcing the mounting of said blades to said radially oriented peripheral section.

14. A fan according to claim 9, wherein said cylindrical surface and planar surface of said rotor are formed in a laminated pack of said rotor.

15. A fan comprising:

fan wheel means which includes a plurality of fan blades and is rotatable about a fan wheel axis, and drive motor means for imparting rotational movement to said fan wheel means, said drive motor means including a stator and a rotor, wherein said fan wheel means includes a fan wheel mounting collar supporting said fan blades, wherein said rotor has an offset portion at the outer periphery thereof, and wherein said collar of said fan wheel means includes a corresponding offset portion engageable over said offset portion of the rotor with a slight press fit therebetween, said collar including an edge portion having a plurality of recesses in the peripheral direction around the circumference thereof for accepting a plurality bendable portions of a wall portion of said rotor so as to axially and peripherally lock said collar into position on said rotor.

16. A fan according to claim 15, wherein said collar of said fan wheel is constructed of synthetic resinous material, and wherein said rotor wall portion having said bendable portions is a part of a short-circuit ring of said rotor.

17. A fan according to claim 16, wherein said collar of said fan wheel means includes an axially oriented collar section and a radially oriented peripheral section where the individual blades are attached.

18. A fan according to claim 17, wherein said axially oriented collar section extends only partially over a rotor lamination pack of the rotor so as to assure a free exposure of the lamination pack to the gas flow in the fan.

19. A fan according to claim 18, wherein said collar of said fan wheel means includes reinforcing ribs distributing uniformly around the circumference of the collar for reinforcing the mounting of said blades to said radially oriented peripheral section.

20. A fan according to claim 15, wherein said offset portion of said rotor includes a cylindrical surface and a planar surface of said rotor, said surfaces being formed in a laminated pack of said rotor.

* * * * *